United States Patent [19]

Cena

[11] Patent Number: 4,553,503

[45] Date of Patent: Nov. 19, 1985

[54] ROTARY PISTON MACHINE

[76] Inventor: Arnulfo Q. Cena, 1415 Hollywood Ave., Glenview, Ill. 60025

[21] Appl. No.: 525,126

[22] Filed: Aug. 22, 1983

[51] Int. Cl.[4] ..... F02B 53/00

[52] U.S. Cl. ..... 123/18 A; 123/43 B

[58] Field of Search ..... 123/18, 43 R, 43 B

[56] References Cited

U.S. PATENT DOCUMENTS

| | | | |
|---|---|---|---|
| 1,037,094 | 8/1912 | Williams | 123/18 R |
| 3,516,392 | 6/1970 | Morgan | 123/18 A |
| 4,434,751 | 3/1984 | Pavincic | 123/43 B |

*Primary Examiner*—Craig R. Feinberg

*Attorney, Agent, or Firm*—Laff, Whitesel, Conte & Saret

[57] ABSTRACT

This invention is an internal combustion engine having arcuate pistons inside a rotating annular cylinder block which is divided into two combustion chambers by a pair of diametrically opposed cylinder heads. Each combustion chamber has an air intake port and an exhaust outlet for burned gases. The arcuate pistons form within the cylinder heads two combustion chambers and two compressors or pumps. The relative rotation of the cylinder and the arcuate pistons is controlled by mechanical scissor-action-type eccentric cranks connected to an eccentrically rotatable ring.

2 Claims, 12 Drawing Figures

10

9

12

11

ROTARY PISTON MACHINE

FIELD OF INVENTION

My present invention pertains to rotary machines and, more particularly, to a rotary internal-combustion engine wherein the arcuate pistons inside a rotating annular cylinder block are actuated by an eccentric scissor action mechanism.

Rotary internal combustion engines are well known in the art. A few examples are Wankel, Kauertz, Tschudi, and Jernaes rotary engines. All of them have some advantages, and some showed promise to be commercialized but most, if not all, failed on the production line for one reason or another. Maybe this is due to the fact that most of these rotary engines use gear or cam mechanisms to crank the engine which is not conducive to the life span of the engine.

It is, therefore, the main object of the present invention to provide a rotary internal-combustion engine which will avoid the use of gears or cams in the crank mechanism in performing the Otto cycle. This is accomplished in the present invention by using an eccentric scissor action mechanism that will perform the cranking.

Another object of the present invention is to provide a rotary internal combustion engine that will rotate freely rather than reciprocate.

This is achieved in accordance with the present invention by a machine characterized by a revolving annular cylinder block divided into two chambers by a pair of diametrically opposed cylinder heads. Each combustion chamber has an air intake port and an exhaust outlet for burned gases. Inside the annular cylinder are a pair of diametrically opposed arcuate pistons which form within the cylinder heads two combustion chambers and two compressors or pumps. The relative angular movement or rotation of the arcuate pistons and cylinder effects intake, compression, combustion and exhaust. The relative rotation of the cylinder and the arcuate pistons is controlled by mechanical scissor-action-type eccentric cranks. These cranks consist of extending yoke arms, link bars, yoke bars and pins. One of the pins is rigidly connected to the two ring bearings and rotates around the large pin, and they are interconnected. This interconnection effects the scissor action. One of the extending yoke arms is rigidly connected to the off-center shaft of the annular cylinder block, while the other extending arm is rigidly connected to the hollow shaft of the arcuate pistons. Upon rotation of the center shaft of the annular cylinder block, the yoke arms and yoke bars together with the ring bearings effect the relative movement of the cylinder heads and the arcuate pistons, causing the drawing, compressing, expanding and expelling of gases in the combustion chambers.

Another new feature of the invention resides in the combination of the off-center boss, ring bearings, pins and levers that form the scissor-action crank mechanism. My previous patent, U.S. Pat. No. 3,645,239, has sun gears and planet gears that form the scissor-action mechanism. The present invention has no gears to effect the relative movement of the cylinder heads and the arcuate pistons to perform the Otto-cycle.

Other objects, features and advantages of the present invention will be clearly understood from the following description, reference being made in the drawings of which:

Figures 5A, 5B, 5C, 5D, 5E, 5F, 5G, 5H:
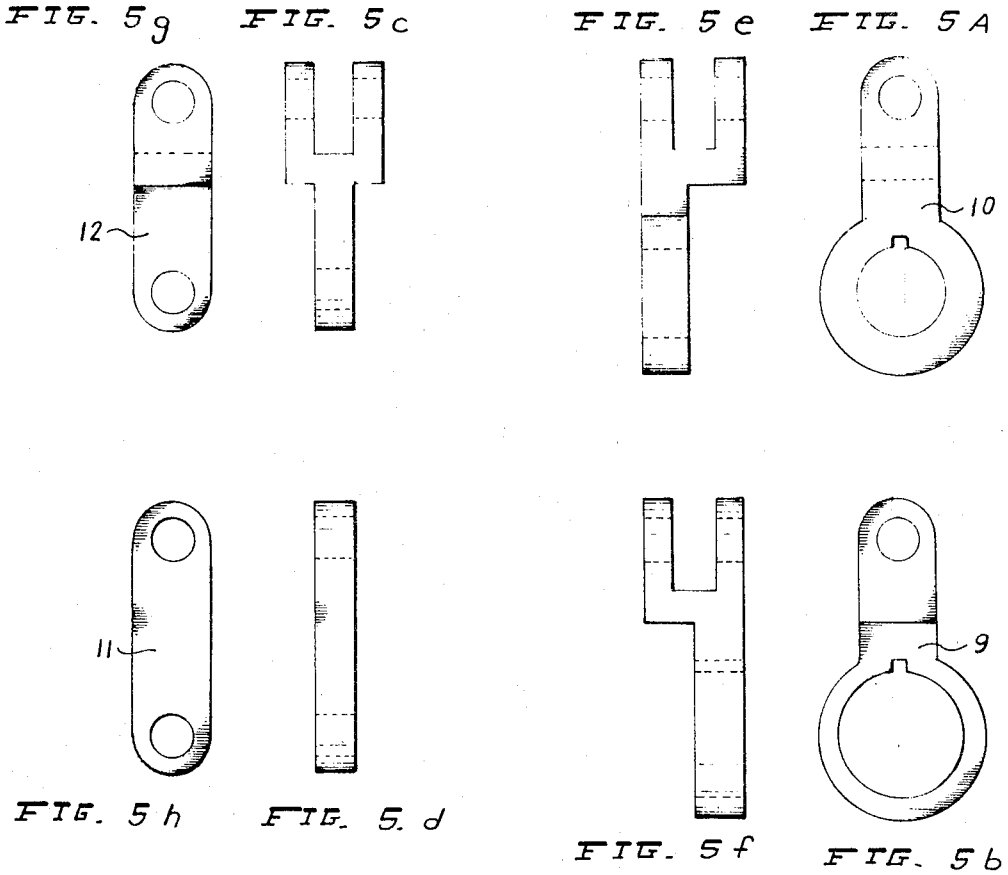

FIG. 5*a* is a top elevational view of one of the yoke arms.

FIG. 5*b* is a top elevational view of the other of the yoke arms.

FIG. 5*c* is a side elevational view of one of the yoke bars.

FIG. 5*d* is a side elevational view of the other of the yoke bars.

FIG. 5*e* is a side elevational view of the yoke arm of FIG. 5*a*.

FIG. 5*f* is a side elevational view of the yoke arm of FIG. 5*b*.

FIG. 5*g* is a top elevational view of the yoke bar of FIG. 5*c*.

FIG. 5*h* is a top elevational view of the yoke bar of FIG. 5*d*.

Figure 1:
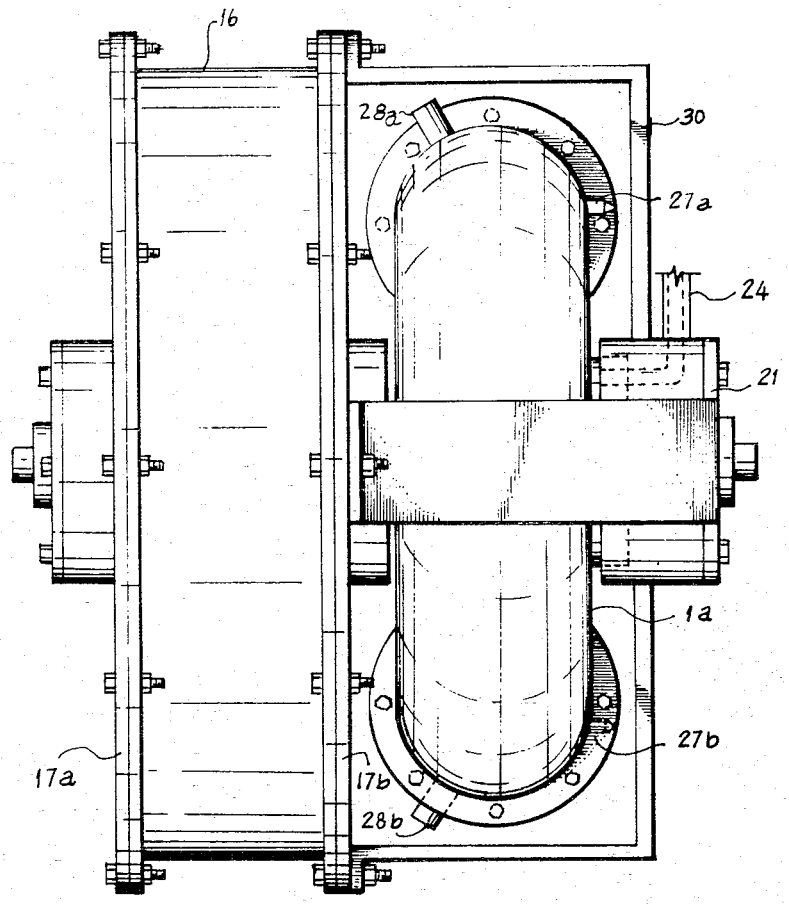
FIG. 1 is a side elevational view of the machine.
Figure 2:
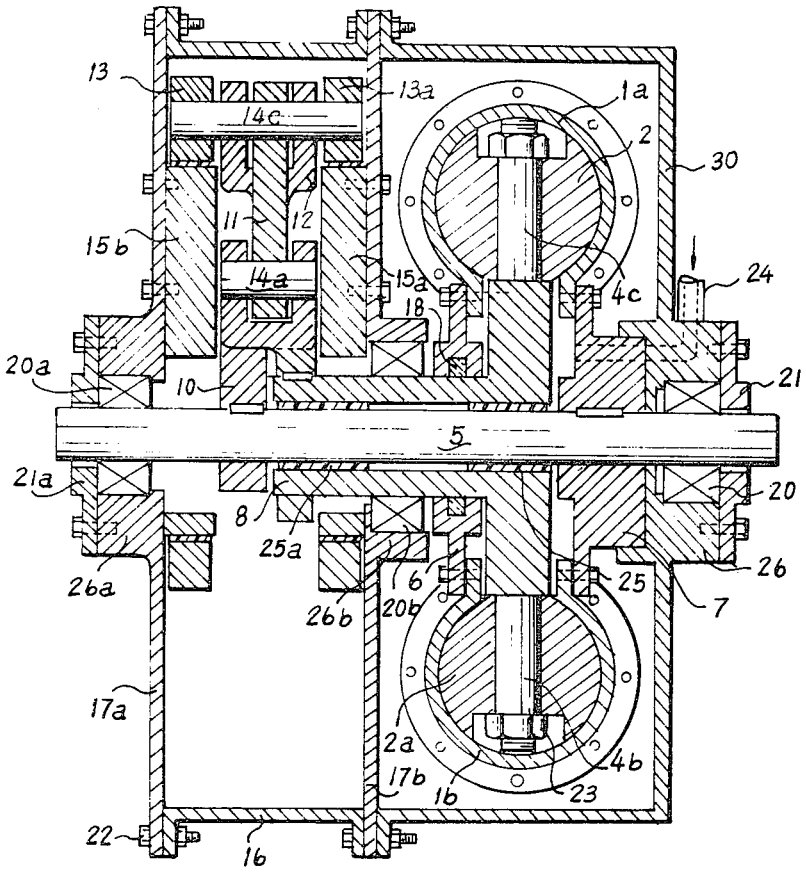
FIG. 2 is an axial sectional view of the machine.
Figure 3:
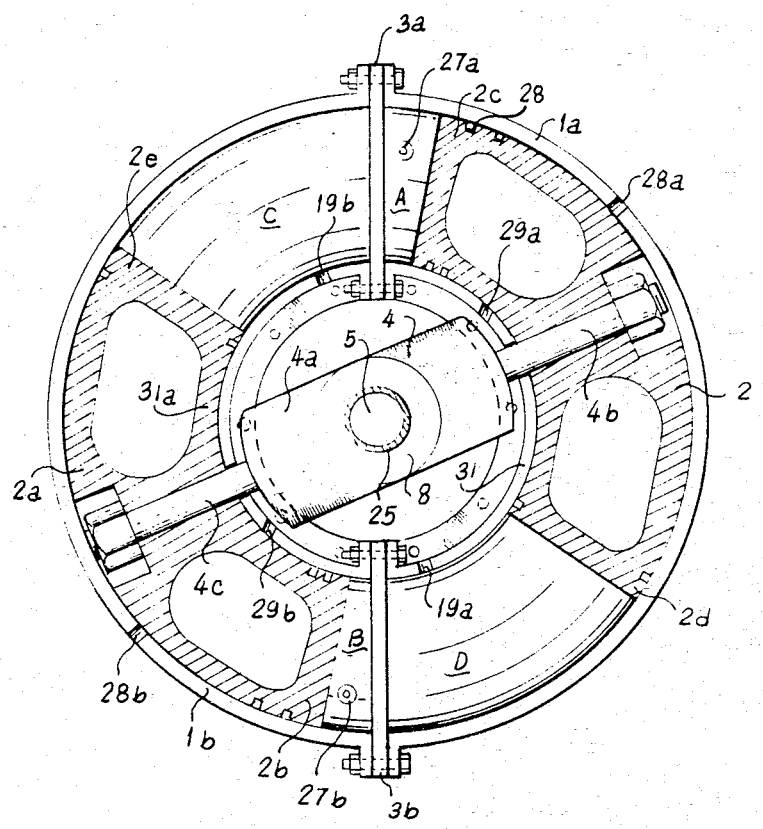
FIG. 3 is a transverse sectional view taken through the annular cylinder block of the engine.

Referring now to FIGS. 1 to 3 of the drawings, the rotary engine as embodied in this invention has support means comprising a cylindrical casing 16 having cover plates 17*a* and 17*b*. These plates are bolted to the flange by bolts 25 of the cylindrical casing 16. Each cover plate has a central boss 26*a* and 26*b* which are coaxial. Cross member 30 with a central boss 26 is also coaxial with the bosses 26*a* and 26*b*, and is bolted together with cover plate 17*b* and the flange of casing 16.

Journaled in the bearings 20, 20*a* and 20*b* in the bosses of plates 17*a*, 17*b* and boss 26 of cross member 30 is the main shaft 5 which is integrally connected to the annular cylinder block 1*a* and 1*b* by a hub 7. This annular cylinder block is essentially a hollow torus having two opposed slits 31 and 31*a* at the inner side thereof. On both sides of the ribs of the annular cylinder block 1*a* and 1*b* are bolted hub 7 and side plate 6. It should be noticed that side plate 6 which rotates relative to the hollow center shaft 8 has a groove to receive seal 18 to make the central annular space air-tight.

The half annular cylinder blocks 1*a* and 1*b* as shown in FIG. 3 are divided diametrically by opposed walls 3*a* and 3*b* which serve as cylinder heads. Substantially on the inner side of the annular cylinder block are the diametrically opposed intake ports 29*a* and 29*b*. Each port is spaced substantially from the front side of the cylinder heads, leading to the combustion chambers A and B. Also on the inner side of the annular cylinder block are suction ports 19*a* and 19*b*. These ports are located close to the rear side of the cylinder head. The suction ports 19*a* and 19*b* lead to the pumping chambers C and D. These pumping chambers and combustion chambers are actually part of the two identical chambers divided by the cylinder heads 3*a* and 3*b*.

On the soft metal bearings 25 of the main shaft 5 is journaled the hollow second shaft 8. On the front end of the second shaft 8 are pairs of radial spokes 4 and 4*a*, and bars 4*c* and 4*b* extending through the two opposite elongated slots 31 and 31*b* on the inner side of the annular cylinder block 1*a* and 1*b*. At each end of the spokes are bolted the arcuate pistons 2 and 2*a* which oscilate within the hollow annular cylinder block 1*a* and 1*b*. At both ends of the arcuate pistons are piston heads 2*b*, 2*c*, 2*d*, and 2*e* with piston rings 28. Between the cylinder heads 3*a* and 3*b* and piston heads 2*c* and 2*b* respectively are formed combustion chambers A and B. Between cylinder heads 3*a* and 3*b* and piston heads 2*e* and 2*d* respectively are pumping chambers C and D in the annular cylinder block.

On the front side of the annular cylinder blocks are threaded holes to receive the spark plugs 27*a* and 27*b* which are located close to the front side of the cylinder heads, while on the rear side of the annular cylinder block are the exhaust ports 28*a* and 28*b*, also shown in FIG. 1.

On the front portion of the annular cylinder block is the hub 7 which is integrally connected to the main shaft 5. Hub 7 has a half moon hole that serves as a rotary valve for the gas and air mixture to enter the air tight central portion of the annular cylinder block, and also communicates with the intake manifold 24 from the carburetor (not shown). The boss 26 seals the half moon hole during the compression of the mixture delivered into the combustion chambers A and B thru intake holes 29*a* and 29*b*.

Figure 4:
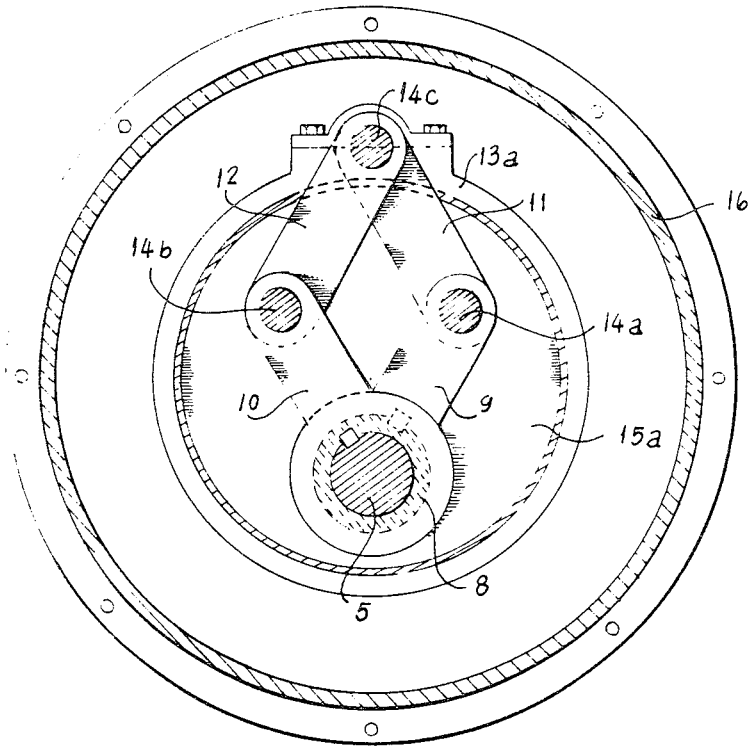
FIG. 4 is a sectional view taken through the scissor-action mechanism casing.

At the near rear end portion of the main shaft 5 is an extending yoke arm 10. Yoke arm 10 is rigidly secured to the main shaft 5 and extending yoke arm 9 is rigidly secured to the end of the hollow second shaft 8. At the end of each of the extending arms is connected a Y link bar 11 or 12 by means of pin 14*a* or 14*b*. Pin 14*b* is rigidly attached to the yoke arm 10, while yoke link bar 12 is loosely attached to pins 14*b* and 14*c*. Pin 14*a* is also rigidly secured to the extending yoke arm 9. Link bar 11 is loosely attached to pins 14*a* and 14*c*. Both ends of pin 14*c* are rigidly secured to rings 13 and 13*a*. Rings 13 and 13*a* are rotating on bosses 15*a* and 15*b* and eccentrically placed off center to the main shaft 5 and hollow shaft 8 as shown in FIG. 2 and FIG. 4. During the rotation of pin 14*c* together with rings 13 and 13*a* around the bosses 15*a* and 15*b*, extending arms 9 and 10 move in reciprocating motion simultaneously with the annular cylinder block 1*a* and 1*b* in relation to pistons 2 and 2*a*. This reciprocating motion is caused by the opening and closing movement of extending arms 9 and 10.

The operation of the two-cycle engine can be understood by looking at FIGS. 3 and 4. The cylinder heads 3*a* and 3*b* are at 360° and 180° position respectively (FIG. 3). Between the said cylinder heads are piston heads 2*b*, 2*c*, 2*d* and 2*e*, combustion chambers A and B, and the pumping chambers C and D. In this position, combustion chambers A and B have finished the compression stroke so that the spark plugs 27*a* and 27*b* are about to ignite the fuel and air mixture by means of a spark distributor (not shown). The burned gases are thus expanded driving apart the cylinder heads 3*a* and 3*b* and piston heads 2*b* and 2*c* in the combustion chambers A and B, simultaneously exhausting the burned gasses, and then compressing the new gas and air mixture in the pumping chambers C and D, and charging again combustion chambers A and B. In FIG. 4 the position of the eccentric crank mechanism is starting to compress the fuel and air mixture in the combustion chambers A and B. When pin 14*c* is at 360° position, pins 14*a* and 14*b* together with extending arms 9 and 10 move far apart, thus completing the compression stroke as shown in FIG. 3. At this instant immediately the power stroke begins forcing the extending arms 9 and 10 to move closer again while rotating and at the same time imparting torque to the main shaft 8.

It will be understood that although two-cycle rotary internal combustion engine are described in this invention a four-cycle engine is also applicable with some minor modifications.

Having described my invention, modifications will be obvious to those skilled in the art, and thus I do not wish to be limited thereto as there might be changes made in the arrangement, disposition and form of the parts without departing from the principle of my invention.

I claim:

1. In a rotary internal combustion engine of the type having support means;

first and second shafts;

means mounting said first and second shafts on said support means for rotation about a first axis;

annular cylinder block means connected to said first shaft for rotation therewith about said first axis;

piston means arcuately reciprocable within, and rotable with, said annular cylinder block means, and connected to said second shaft for rotation therewith about said first axis;

off-axis journal means on said support means;

off-axis rotation means journaled on said off-axis journal means for rotation about a second axis parallel to said first axis;

and respective means interconnecting rotation of said first and second shafts about said first axis with rotation of said off-axis rotation means about said second axis;

the improvement wherein:

said support means comprises at least two wall means spaced along and substantially perpendicular to said axes with at least one of said shafts continuously extending past opposite sides of said support means;

said off-axis journal means comprises substantially circular boss means fixedly mounted on said wall means with the center of said circular boss means at said second axis;

and said off-axis rotation means comprises means circularly interfitting with said boss means in a manner to be rotatably supported thereon.

2. An engine as in claim 1 wherein:

said off-axis rotation means has a substantially annular configuration and said circular boss means is received internally thereof.

* * * * *